US010294777B2

(12) United States Patent
Jarman et al.

(10) Patent No.: US 10,294,777 B2
(45) Date of Patent: May 21, 2019

(54) STEERING TOOL SYSTEM

(71) Applicants: Patrick Jarman, Mt. Pleasant, MI (US); Philippe Giacalone, Mt. Pleasant, MI (US); Rick Kleinhans, Mt. Pleasant, MI (US); Brian Wright, Mt. Pleasant, MI (US); Jeffrey Adams, Mt. Pleasant, MI (US); Nigel Rowcliffe, Mt. Pleasant, MI (US)

(72) Inventors: Patrick Jarman, Mt. Pleasant, MI (US); Philippe Giacalone, Mt. Pleasant, MI (US); Rick Kleinhans, Mt. Pleasant, MI (US); Brian Wright, Mt. Pleasant, MI (US); Jeffrey Adams, Mt. Pleasant, MI (US); Nigel Rowcliffe, Mt. Pleasant, MI (US)

(73) Assignee: CUDD PRESSURE CONTROL, INC., The Woodlands ( * ) Notice: Subject to any disclaimer, the term of this patent is extended or adjusted under 35 U.S.C. 154(b) by 168 days.

(21) Appl. No.: 15/220,882

(22) Filed: Jul. 27, 2016

(65) Prior Publication Data

US 2017/0051600 A1 Feb. 23, 2017

Related U.S. Application Data

(60) Provisional application No. 62/197,273, filed on Jul. 27, 2015.

(51) Int. Cl.

| | |
|---|---|
| ***E21B 4/04*** | (2006.01) |
| ***E21B 7/06*** | (2006.01) |
| ***E21B 47/12*** | (2012.01) |
| ***E21B 7/04*** | (2006.01) |
| ***E21B 19/22*** | (2006.01) |

(52) U.S. Cl.
CPC ..... *E21B 47/12* (2013.01); *E21B 7/04* (2013.01); *E21B 19/22* (2013.01)

(58) Field of Classification Search
CPC ..... E21B 47/12; E21B 7/04; E21B 19/22
See application file for complete search history.

(56) References Cited

U.S. PATENT DOCUMENTS

| | | | | |
|---|---|---|---|---|
| 4,180,132 | A * | 12/1979 | Young | E21B 23/006 166/120 |
| 5,413,045 | A | 5/1995 | Miszewski | |
| 6,354,379 | B2 | 3/2002 | Miszewski | |
| 6,523,609 | B1 | 2/2003 | Miszewski | |
| 6,698,534 | B2 | 3/2004 | Miszewski | |
| 6,762,601 | B2 | 7/2004 | Miszewski | |
| 6,763,900 | B2 | 7/2004 | Miszewski | |

(Continued)

*Primary Examiner* — D. Andrews
*Assistant Examiner* — Yanick A Akaragwe
(74) *Attorney, Agent, or Firm* — Winstead PC

(57) ABSTRACT

A steering tool system may provide a bottom hole assembly (BHA) and a surface control/interface (SCI). The steering tool may provide an improved electronic schematic that provides a data line that is separate from the power line. The BHA may provide a full bore flow path. The connectors of a cablehead section may be designed to ease make up with proper contact to the connectors. The BHA may also be suitable for pumping a ball to a hydraulic disconnect. The design of the system allows conductors to pass through the hydraulic disconnect and orienter control section.

18 Claims, 8 Drawing Sheets

(56) References Cited

U.S. PATENT DOCUMENTS

| | | | | |
|---|---|---|---|---|
| 8,322,433 | B2 * | 12/2012 | Bedouet | E21B 17/07 166/250.01 |
| 9,045,968 | B2 * | 6/2015 | Sihler | H01R 39/643 |
| 9,194,219 | B1 * | 11/2015 | Hardesty | F42D 1/05 |
| 2003/0052670 | A1 | 3/2003 | Miszewski | |
| 2003/0066645 | A1 * | 4/2003 | Armatage | E21B 23/08 166/253.1 |
| 2008/0089175 | A1 | 4/2008 | Miszewski | |
| 2009/0266544 | A1 * | 10/2009 | Redlinger | E21B 4/02 166/298 |
| 2010/0018770 | A1 * | 1/2010 | Moriarty | E21B 7/04 175/45 |
| 2011/0061938 | A1 | 3/2011 | Miszewski | |
| 2012/0173196 | A1 | 7/2012 | Miszewski | |
| 2016/0076341 | A1 * | 3/2016 | Burguieres | E21B 41/0007 166/340 |
| 2016/0084029 | A1 * | 3/2016 | Castillo | E21B 31/00 166/297 |
| 2016/0258276 | A1 * | 9/2016 | Donderici | E21B 47/02216 |

* cited by examiner

STEERING TOOL SYSTEM

RELATED APPLICATIONS

This application claims the benefit of U.S. Provisional Patent Application No. 62/197,273 filed on Jul. 27, 2015, which is incorporated herein by reference.

FIELD OF THE INVENTION

This invention relates to a steering tool system of a downhole tool.

BACKGROUND OF INVENTION

Steering tools may be utilized for directional drilling and may be implemented in a variety of different manners. A rotating mechanism, such as an electric motor, may rotate a bottom hole assembly (BHA) to direct a bit in a desired direction. The motor may be coupled to a wireline that connects the BHA to surface equipment. These steering tools may have various drawbacks due to its complicated nature.

An improved steering tool system is discussed further herein. The steering tool system may provide, but is not limited to, improvements in the electronic arrangement, bore pathway of the tool, conductor connection mechanisms, hydraulic disconnect mechanisms, and the like.

SUMMARY OF INVENTION

In one embodiment, a steering tool system may provide a bottom hole assembly (BHA) and a surface control/interface (SCI) with an improved electronic schematic. The connectors of a cablehead section may be designed to ease make up with proper contact to the connectors. The full bore cablehead provides a means such that the BHA may be suitable for pumping a ball to a hydraulic disconnect. The design of the system allows conductors to pass through the hydraulic disconnect and orienter control section.

The foregoing has outlined rather broadly various features of the present disclosure in order that the detailed description that follows may be better understood. Additional features and advantages of the disclosure will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
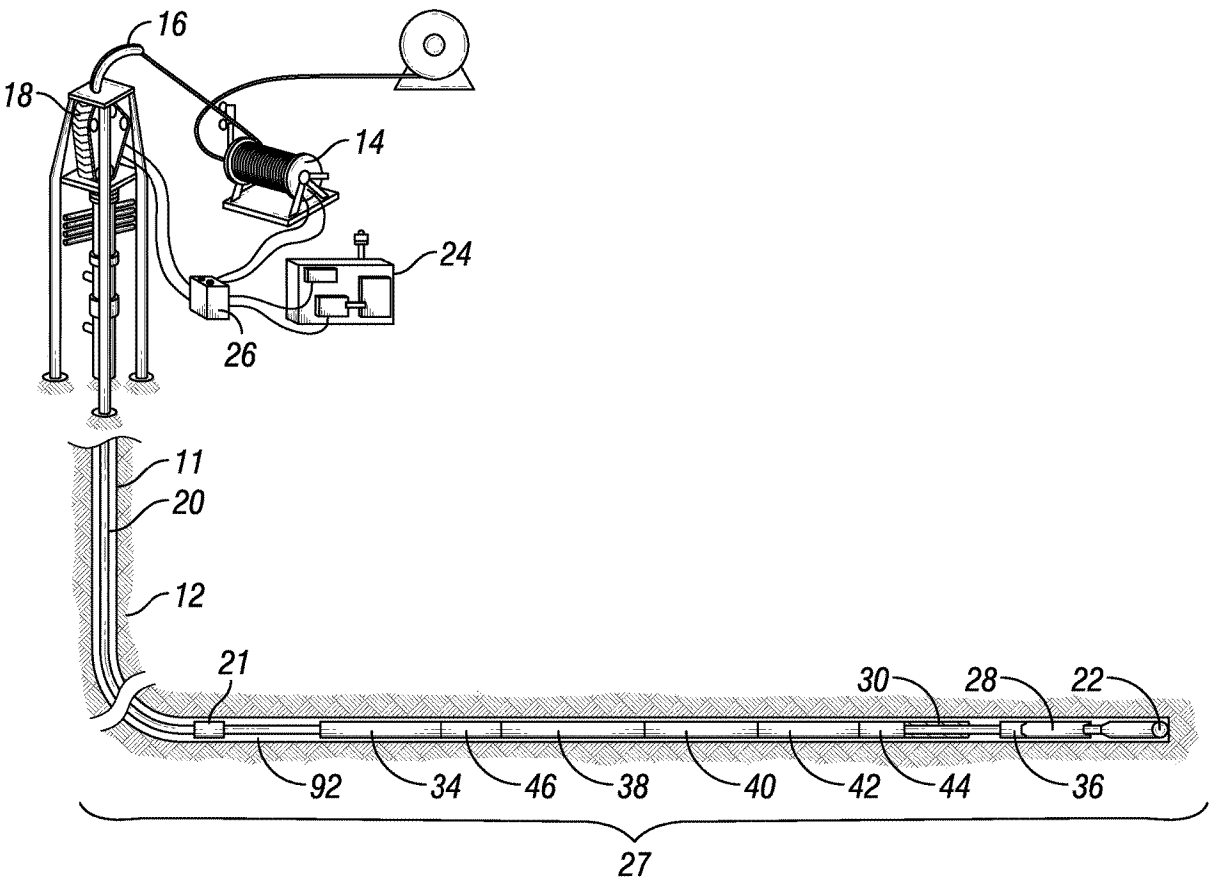
FIG. 1 is a schematic diagram illustrating a coiled tubing drilling system.

Refer now to the drawings wherein depicted elements are not necessarily shown to scale and wherein like or similar elements are designated by the same reference numeral through the several views.

Referring to the drawings in general, it will be understood that the illustrations are for the purpose of describing particular implementations of the disclosure and are not intended to be limiting thereto. While most of the terms used herein will be recognizable to those of ordinary skill in the art, it should be understood that when not explicitly defined, terms should be interpreted as adopting a meaning presently accepted by those of ordinary skill in the art.

It is to be understood that both the foregoing general description and the following detailed description are exemplary and explanatory only, and are not restrictive of the invention, as claimed. In this application, the use of the singular includes the plural, the word "a" or "an" means "at least one", and the use of "or" means "and/or", unless specifically stated otherwise. Furthermore, the use of the term "including", as well as other forms, such as "includes" and "included", is not limiting. Also, terms such as "element" or "component" encompass both elements or components comprising one unit and elements or components that comprise more than one unit unless specifically stated otherwise.

FIG. 1 is a schematic diagram illustrating a coiled tubing drilling system 27 (e.g. including various components, such as 21+92+30+36+28+22) for drilling a well bore 11 in an underground formation 12. The coiled tubing drilling system 27 may be placed in the formation 12, thereby providing an annulus 92 between the formation and string. The coiled tubing drilling system can include a variety of surface equipment, such as coiled tubing reel 14, a goose neck tubing guide 16, a tubing injector 18, a coiled tubing 20, a coiled tubing connector 21, a drill bit 22, and/or a steering tool 40 at the bottom of the well bore. It shall be understood that downhole equipment may include a variety of additional tools. As nonlimiting examples, the system may also include a control cab 24, a power pack 26, other BHA tools 92+27+30+36+28, downhole motor 28, non magentic flex sub 30, gamma/weight on bit/torque on bit/tubing pressure/annulus pressure/differential pressure sensor/s 44, MWD/LWD tool including wireline communication module 42, jar and vibration-inducing tool 36, electronic orienter module 38, motor control module 46, hydraulic disconnect 34, quick/wet connect 92, and/or other special purpose tools.

General/Overall System Function

Figure 2:
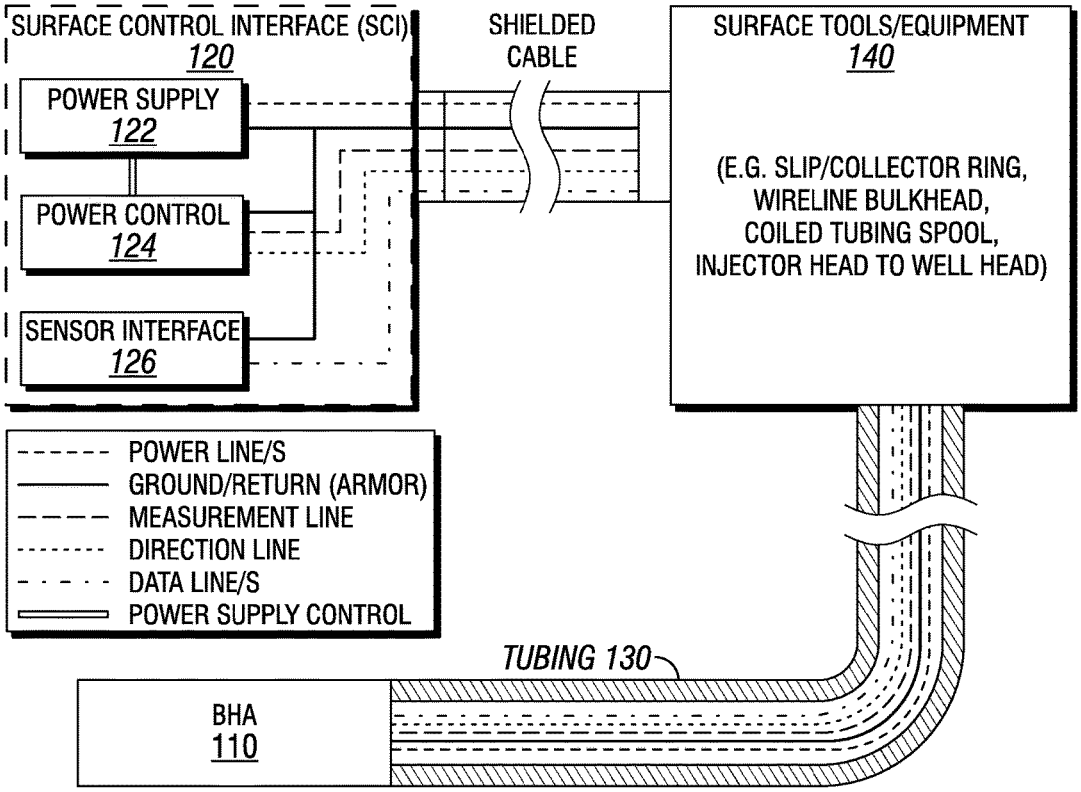
FIG. 2 is an electronic schematic of a steering tool system.

FIG. 2 is an electronic schematic of a steering tool system. A Steering Tool System (STS) may comprise a Bottom Hole Assembly (BHA) 110 and a Surface Control/Interface (SCI) 120. The BHA 110 may include an orienter and is run on the end of tubing 130, such as, but not limited to, coiled tubing. Communications between the BHA 110 and SCI 120, and power is supplied to the SCI via multi-conductor wireline. In some embodiments, the wireline may provide seven conductors, but the system could run on more or fewer conductors if the wireline allows. In some embodiments, the conductors may run from the SCI 120 through surface tools/equipment 140 (e.g. slip/collector ring, wireline bulkhead, coiled tubing spool, injector head to well head, etc.)

and to BHA 110 in a well. A common ground/reference is used, which may be the body of the BHA and the wireline armor. A wireline conductor arrangement may be as follows: one conductor for additional BHA tool(s) (or Data Line(s)), one conductor for switching orienter motor direction (or Direction Line), one conductor for reading wireline resistance and voltage supplied to the BHA (or Measurement Line), and one or more of the remaining conductors can be used to send power to the BHA or orienter (or Power Line(s)).

Other systems may utilize a single conductor wireline to provide two-way communication with the BHA or a multi-conductor wireline with the communications conductor (e.g. Data Line) is used to receive downhole data, as well as provide a means to communicate with the electronic motor control. However, there is a point in these systems where the low power communication lines may undesirably switch on and off the high power electric motor lines due to the downhole data interfering with motor control signals.

In contrast to these other system, the system discussed herein does not combine downhole communication or sensor signals with control signals for other functions, such as motor control, since SCI 120 provides control at the surface. Instead, the system provides a dedicated Data Line(s) for such downhole communication or sensor signals and the Data Line(s) is free of any orienter control signals. The Data Line(s) may be for use with a sensor package, but not limited to such application. This unique feature allows the placement of any single conductor tool in or on the end of our BHA. While the embodiment show has one line for the Data Line, other embodiments may potentially dedicate more lines to run multiple single conductor wireline tools or more complex multi-conductor wireline tools.

The remaining lines in the multi-conductor wireline may be used for the orienter section of the BHA. The Direction Line provides switching to control the motor rotation direction. The Measurement Line may allow wireline resistance and voltage supplied to the BHA to be measured. Power Line(s) may be used to send power to the BHA. This orienter section may be fixed at the top to the end of the tubing via a cablehead or the like (discussed further below) and provides the ability to rotate the rest of the BHA below the orienter section relative to the tubing. The orienter may be rotated using an electric motor, such as a 3-phase brushless DC electric motor, which drives a series of gearboxes creating an output rotation. When it is desirable to rotate the lower portion of the BHA, regulated power is sent from a power supply at surface to the BHA via the wireline. Downhole electronics may filter the power before it goes to the controller and drivers. As a nonlimiting example, the electric motor may have Hall Effect sensors which determine magnet location on the rotor relative to the coil orientation on the stator. The Hall Effect sensor signals may allow the motor controller chip to create the 3-phase wave modulation to the drive to sequence the power to the DC motor. Using the 3$^{rd}$ party sensor(s) in the lower section of the BHA, the orientation of the tool relative to a datum can be observed (e.g. toolface). Once the desired orientation is achieved, the power may be stopped at the surface. The direction in which the orienter rotates is determined by the direction selected at the surface. This direction switch not only initiates the power supply to the BHA, but also switches a low power signal on the Direction Line. Depending on the desired direction the Direction Line is powered on or off. This 12V signal directly inputs to the reverse input on the motor controller chip.

This control system is unique in that it is controlled/switched using lines from surface, rather than sending a signal downhole to operate downhole controls and switchgear. This method builds in inherent reliability since there are less electronics downhole, i.e. less potential for failure.

The orienter may be controlled from a panel at surface or SCI 120. The SCI 120 may include a power supply 122 coupled to a power controller 124 by a power supply control line. The power supply 122 supplies power to the BHA 110, including the orienter, in accordance with instructions from the power controller 124. In this system the orienter is controlled at the surface with the SCI 120. Other systems provide power to the orienter via Power Line(s) and also send orienter control signals via Data Line(s) downhole, but the Data Line(s) may also be used for other tools for the BHA (e.g. sensor package sending downhole data) that may unwantedly switch on or off the Power Line(s). The SCI 120 further includes a sensor interface 126 for receiving downhole data from the BHA 110, such as from additional tools of the BHA other than the orienter. This panel may include a 3$^{rd}$ party power supply and regulator and switching system (RSS) to operate the power supply. In standby mode, the RSS reads the wireline resistance. When the toolface of the BHA needs to be changed, the orienter is functioned by selecting to turn clockwise or counter-clockwise using either a physical switch or using software. On selecting a direction, the RSS may ramp up the power output according to the last wireline resistance reading. When the orienter is running, the function of the Measurement Line changes from reading wireline resistance to measuring the voltage supplied to the BHA. The RSS may use the BHA voltage reading to maintain an optimum supply voltage regardless of changes in wireline resistance from temperature changes or the like. On stopping the orienter, the voltage Measurement Line returns to reading wireline resistance in preparation for the next function of the orienter. If a part of the system fails or a power surge occurs, an over-voltage protection system is in place to protect the electronics.

The orienter provides rotation by means of direct drive through a series of gearboxes from an electric motor. This method provides the ability to rotate in either direction on demand. With no mechanical stops, this orienter has the ability to rotate continuously in either direction. Other technology using a lead screw to provide rotation limits the orientation to a 400 deg range.

By having the BHA wired as explained above, the low power lines to the sensors are at no point connected to the high power lines that run the orienter. This is unique to this tool, as similar tools use a sensor line to select orienter direction. By having these two systems separate the chance of damaging the sensor electronics with orienter power is vastly reduced. Voltage regulation at surface also reduces the amount of BHA electronics, thereby reducing the failure modes of the BHA, making the system inherently more reliable.

Bottom Hole Assembly: Cablehead

Figure 3A:
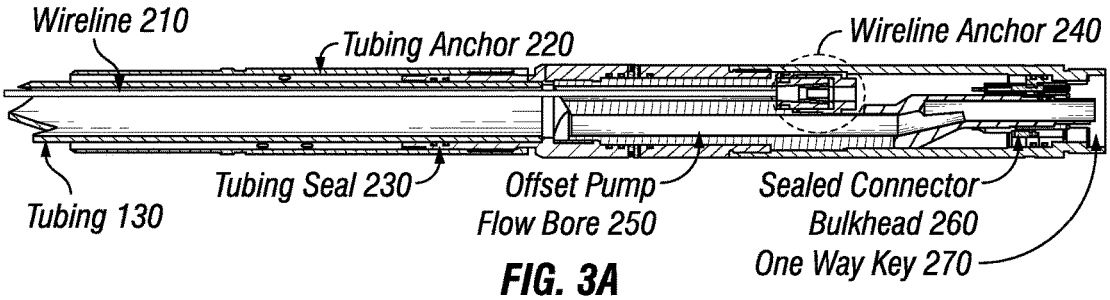
FIGS. 3A-3B show a schematic of an upper cablehead section.
Figure 3B:
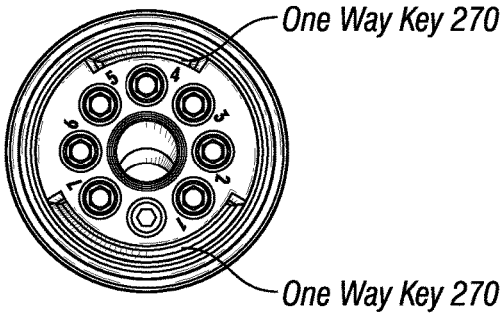

The tubing conveying the downhole tool and the multi-conductor wireline providing electrical contact between surface equipment and downhole tool (e.g. FIG. 1) are terminated and secured at the top of the downhole tool. FIGS. 3A-3B show a schematic of an upper cablehead section. The tubing 130 is terminated, sealed and secured using standard tubing connector technology (e.g. tubing anchor 220, tubing Seal 230, or the like). The wireline 210 is terminated in a custom cablehead. The wireline anchor 240 is offset from the center of the downhole tool allowing a full bore flow path 250 on the opposite side of the tool section. Below the wireline termination the flow path 250 is directed to run through the center of the downhole tool, all with a single full bore flow path. This flow path may be used to pump a ball through section of the tool. As a nonlimiting example, the ball may be pump through to a hydraulic disconnect.

From the wireline anchor 240, the individual lines link up to a sealed connector bulkhead 260 that provides a sealed annualar region between the wireline anchor 250 and the bottom end of upper cablehead section. The wireline conductors may be individually terminated by means of a standard contact and boot, which fits on to mating feedthrus in the sealed connector bulkhead 260. The feedthrus may be arranged concentrically and with reference to a special one way key in the bulkhead 260. The feedthru ports in the bulkhead 260 are numbered. The lower end of the outer housing is uniquely keyed 270 such that the mating part can only fit one way. This system is used to enable the upper cablehead and lower cablehead sections to be made up correctly every time.

Figure 10A:
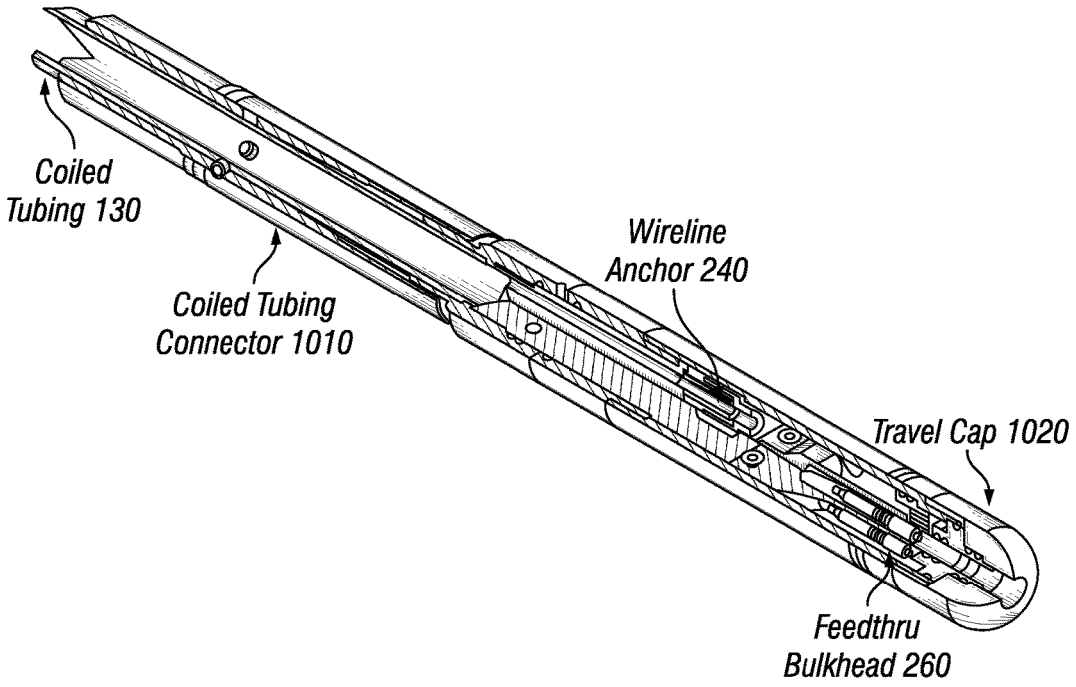
FIGS. 10A-10B are schematics of an upper cablehead section and travel cap.
Figure 10B:
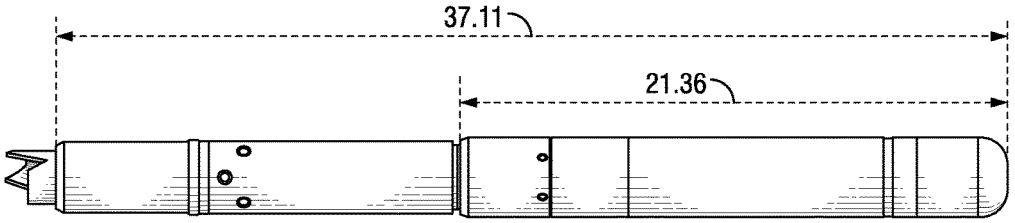

FIGS. 10A-10B are schematics of an upper cablehead section prepared for transport. The upper cablehead section has been designed to be equal to or less than 40 inches in total length and equal to or less than 24 inches make up length beyond the end of the coiled tubing 130 such that it can remain made up on the end of coiled tubing during transport or the like. This enables the tedious wireline termination to be completed in the shop prior to a job. It also enables multiple jobs to be completed without the need to redo the coil tubing connection (e.g. connection between coil tubing 130 and coiled tubing connector 1010) and/or the wireline connection (e.g. wireline anchor 240 and bulkhead 260 if necessary) every time. In order to provide an environmental seal and protect the end of the upper cablehead section a travel cap 1020 can be used for transit (e.g. FIGS. 10A-10B). To further the flexibility of this cablehead various adapters can be placed on the lower end of the upper cablehead section to complete various conventional coiled tubing tasks or e-coil tasks.

Figure 11A:
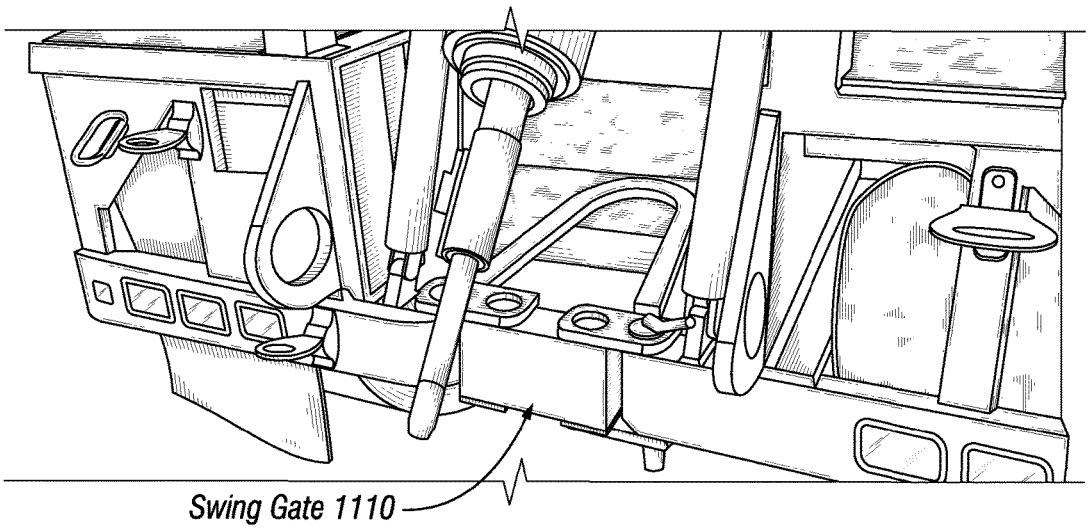
FIGS. 11A-11B are a schematic of a swing gate and U-shaped slot.
Figure 11B:
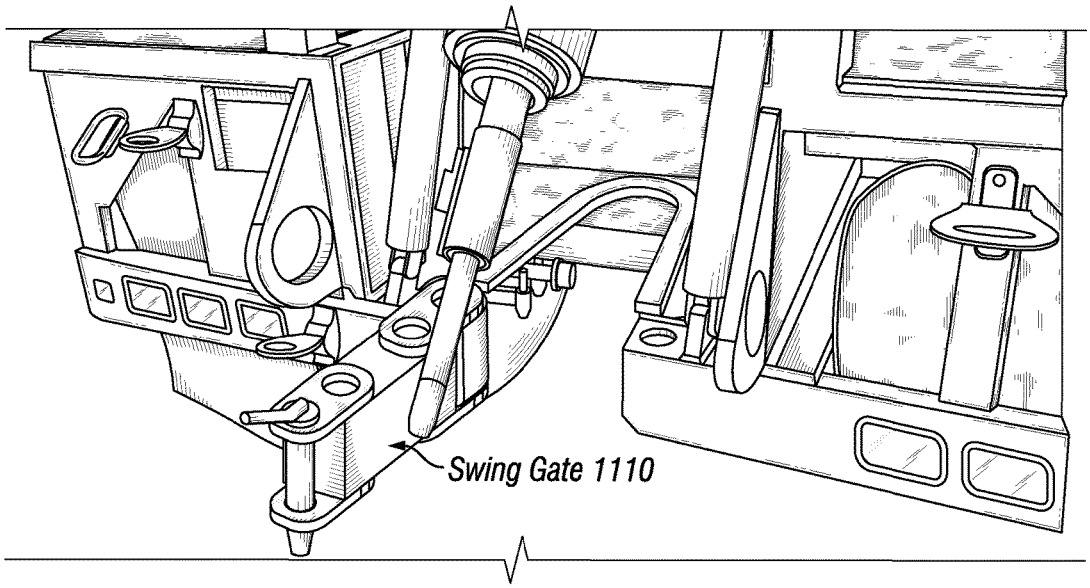

In order to lay down the injector head with the cablehead still in place, not only is there a short cablehead upper section, but the back of coil units can be modified as well. Instead of a fixed cross member across the back of the coil unit, a swing gate 1110 which is pinned at each end may be provided (e.g. FIGS. 11A-11B). The gate may pivot on either pin or be completely removed. To go down the highway, the gate can be pinned shut providing structural strength for the coiled tubing unit while in transit. Once the coil is spotted, one or both of the pins can be pulled and the gate can be swung open or removed providing an area for the cablehead upper section to pass through when standing the injector head up. This custom swing gate saves a lot of time on location, as the cablehead can be made up at a shop and between jobs there is no need to cut it off and re-head. The 'U' shaped slot in the base plate may be modified to accommodate tools made up on the end of the coil. When the injector head is stood up the tool pivots from the position shown through the swing gate opening and ends in a vertical position in the center of the curvature in the 'U' shaped plate.

Figure 4A:
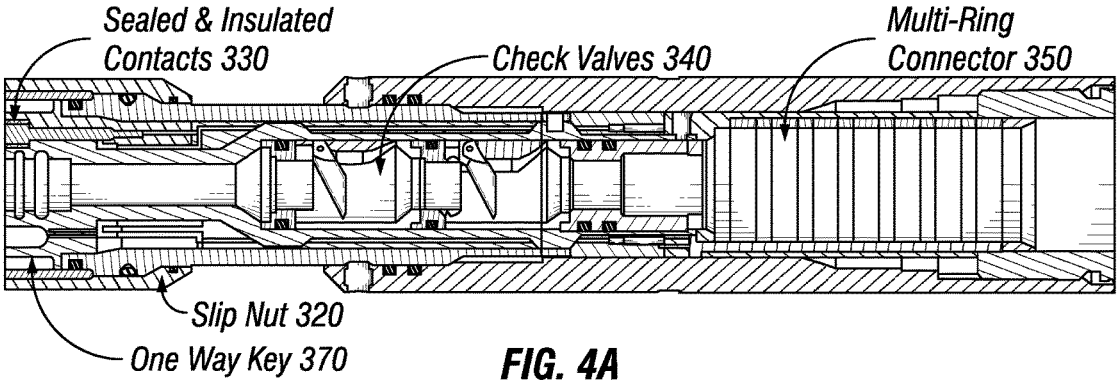
FIGS. 4A-4B show a schematic of a lower cablehead section.
Figure 4B:
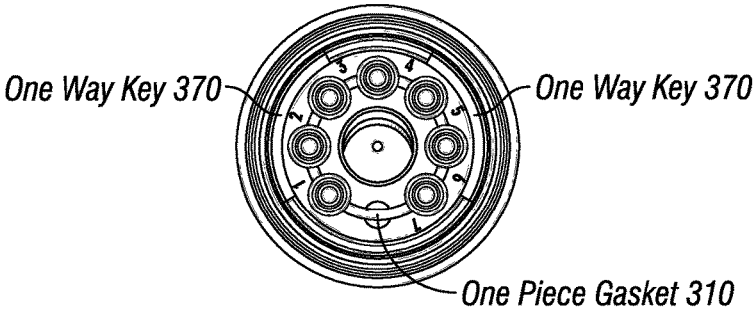

FIGS. 4A-4B show a schematic of a lower cablehead section that can be connect to the upper cablehead section for operation. In order to make connection between the feedthrus and the lower section, the feedthrus used have spring contacts which mate on to contact pads on the lower cablehead section or vice versa. Each spring contact and contact pad is sealed from each other and the metal body such that this connection between the upper and lower cablehead sections can be made in the presence of moisture, and still provides a reliable clean connection without shorting to ground or another conductor. The lower cablehead contacts are insulated using a one piece gasket 310 with multiple gasket rings (e.g. seven), which can easily be replaced.

The contacts 330 on the lower cablehead section may be arranged in the same sequence relative to the special key 370 as the upper cablehead section. When the keys 270, 370 are engaged, a slip nut 320 is used to connect the two sections together. This slip nut 320 rotates about the tool pinching the keyed section together. The threads and shoulder on the slip nut hold all the axial forces while the keys hold all the torsional forces.

The connection between the upper and lower cablehead sections may offer a primary method for making up the BHA 110 to the end of the tubing, such as where the upper cablehead section would be made up to the tubing and the lower cablehead section made up to the rest of the BHA. This connection is robust enough to be made up under normal coiled tubing conditions, e.g. crane holding an injector head. The special key system ensures the contacts align properly. A custom jack up tool can be used to assist with this rig up portion of the process. The jack up tool is used to hold the lower section upright in a well, in a lubricator, or in a rat hole. To reduce risk of damaging the BHA when the crane operator gets the connection aligned axially and lowered to within 3", the crane can be isolated. The lower section of the BHA can then be jacked up by means of hydraulic rams in a controlled manner to engage the keys and make face-to-face contact before making up the slip nut. In other embodiments, the sections can be rigged up without this jack up tool, if needed, offering a wider range of rig up methods.

As for the internals of the lower cablehead section, the flow path is full bore and through the center of this section. Within this lower cablehead section may be a check valve(s) 340 (e.g. double check valve). Electrically the contacts 330 are connected to a multi-ring connector 350, where the wires travel in a sealed annular space between the check valves and the outer housing. From this multi-ring connector 350 potentially any variety of tools could be connected.

Hydraulic Disconnect

Figure 5:
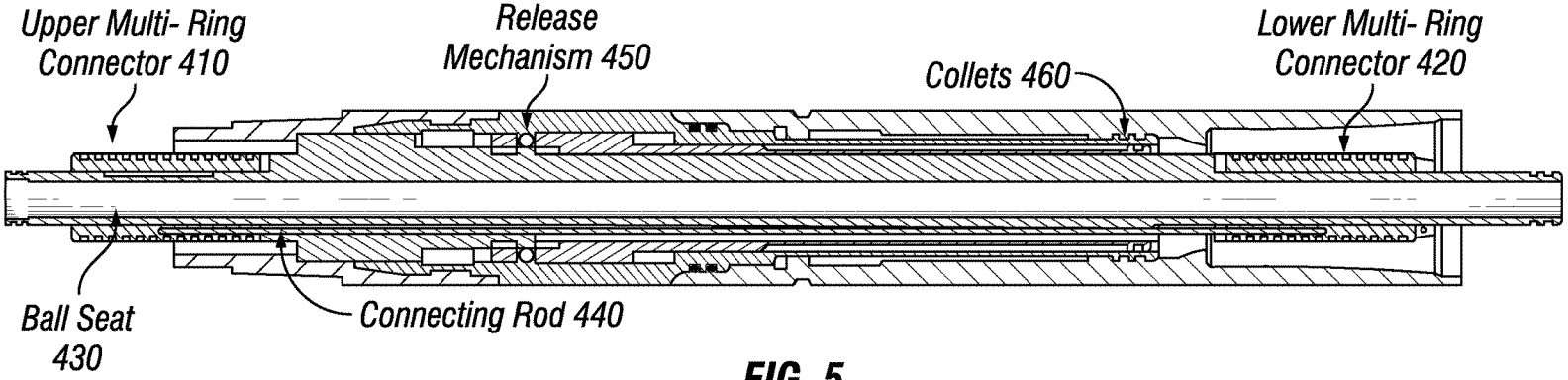
FIG. 5 shows a schematic of a hydraulic disconnect.

FIG. 5 shows a schematic of a hydraulic disconnect section. The multi-ring connector 350 on the bottom of the lower cablehead section may connect to the top of the hydraulic disconnect. Wires may run from the upper multi-ring connector 410 to a lower multi-ring connector 420 in a pressure sealed annular chamber. The full bore flow path through the cablehead allows a ball to be pumped through to the hydraulic disconnect. In the hydraulic disconnect, a restriction 430 (e.g. ball seat) exists in the flow path where a ball may seat. When the ball seats, pressure can be applied against the ball. A connecting rod 440 below the upper multi-ring connector 410 is coupled to a release mechanism 450. The number of shear pins in the release mechanism 450 determines a pressure at which the shear pins will break. When the shear pins break, the ball seat sleeve slides up releasing collets 460 holding the hydraulic disconnect together. This system can be used as a last resort, if the BHA is stuck and cannot be pulled by the tubing used to convey the tool. If activated, the tubing connector, cablehead, and top of the hydraulic disconnect can be retrieved leaving the rest of the BHA behind.

A unique feature of this hydraulic disconnect is that is has conductors passing through it. Multi-ring connectors have been mounted on the end of the release mandrel, and passing all connecting rods between the multi-ring connectors along the same release mandrel. Connecting rods with spring contacts on each end may be used to make connections so it is unnecessary to rely on wires, which can get pinched easily.

Figure 7:
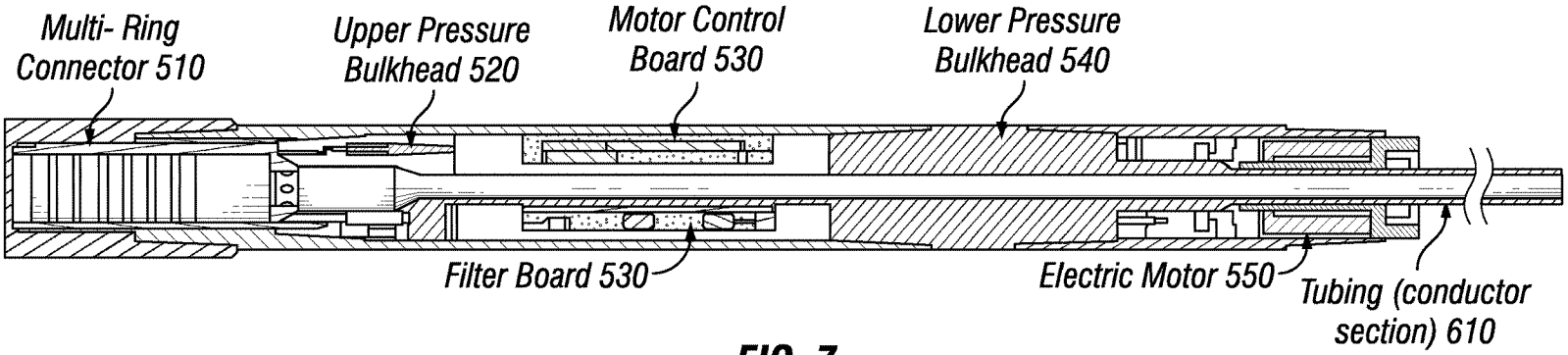
FIG. 7 is a schematic of an orienter control section.
Figure 6:
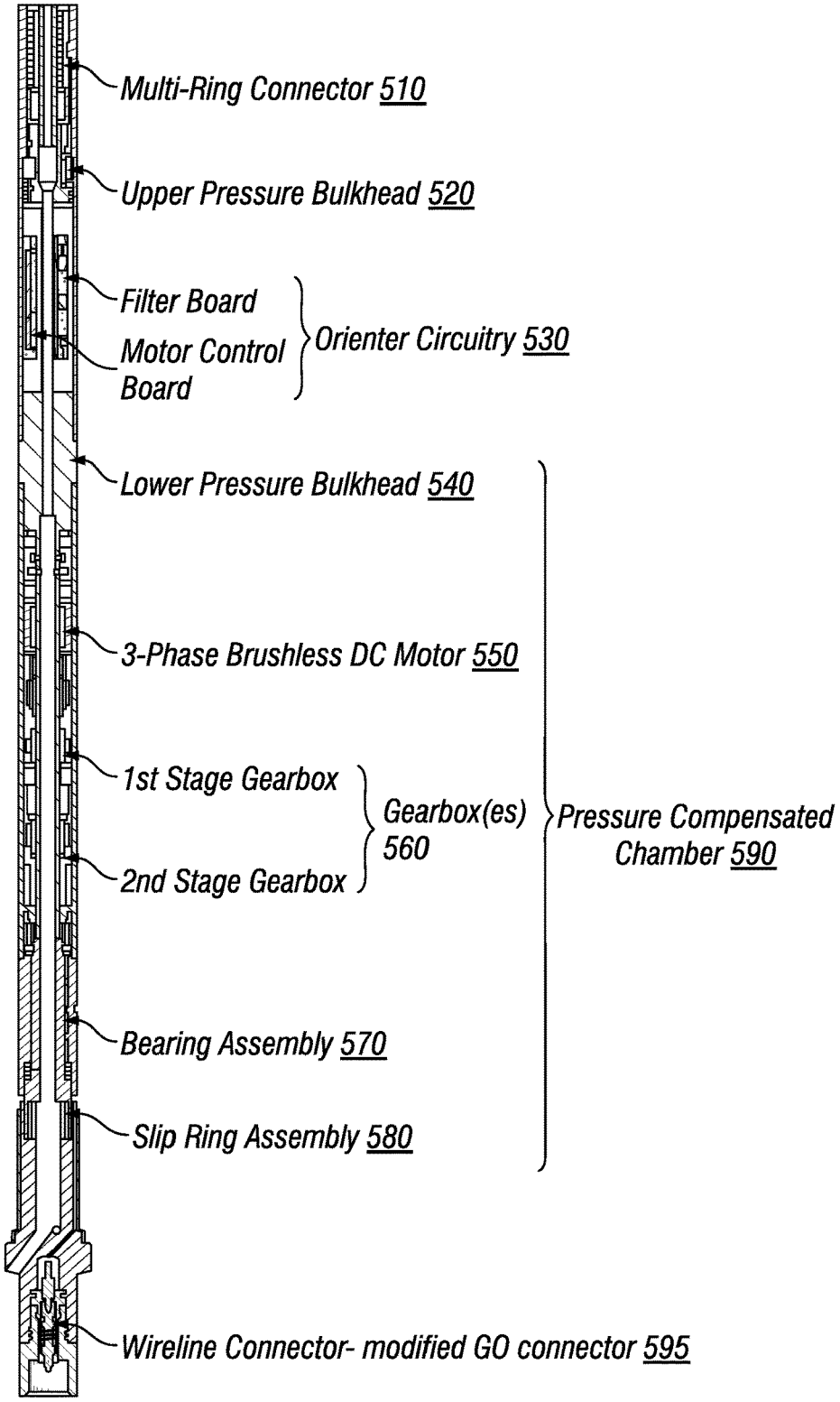
FIG. 6 shows a schematic of an orienter.

FIG. 6 shows a schematic of an orienter, and FIG. 7 is a schematic of an orienter control section. The flow path from the hydraulic disconnect runs full bore through the center of the orienter section. The wires from the hydraulic disconnect connect to the top of the orienter section by means of the multi-ring connector 510. The power supply wires pass through the orienter circuitry 530, e.g. filter board and motor control board. The Direction Line may go directly to the motor control board. The Data Line(s) (or sensor line) may pass right through this section of the orienter. The filter and motor control boards 530 are mounted to the center flowtube inside a sealed housing, providing a completely sealed environment between an upper 520 and lower 540 pressure bulkhead. Under normal conditions the upper pressure bulkhead 520 does nothing, but if the hydraulic disconnect is operated the upper pressure bulkhead prevents the board chamber from flooding. The wires to and from the electric motor, as well as the Data Line(s), pass through the lower pressure bulkhead 540 by means of feedthrus to a pressure compensated chamber 590. The pressure compensated chamber 590 is an oil filled annular chamber and contains the electric motor 550, gearbox(es) 560 (e.g. first stage gearbox, second stage gearbox), bearing drive assembly 570, and slip ring assembly 580. As a nonlimiting example, pressure compensated chamber 590 may be sealed by lower pressure bulkhead 540 and a pressure compensation piston. The pressure compensated chamber 590 provides lubrication to the electric motor 550, gearboxes 560 and drive assembly while dramatically reducing differential pressure forces on the external and internal components/housings and the pressure seals. The pressure compensated chamber 590 may minimize or prevent the loss of oil from the chamber and entry of unwanted fluids from outside the chamber. The full bore flow path and Data Line(s) runs through the middle of all the components inside the pressure compensated chamber to a connector 595 at the bottom of the orienter. The pressure compensated chamber is pressurized by the fluid in the flow path, which acts on the lower side of the pressure compensation piston. The electric motor stator may have a positive mechanical key to stop rotation. In contrast, other motors may rely on friction forces alone to stop rotation, which has proven unreliable.

Note the full bore pump flow path through the center of this section. As shown in further detail in FIG. 7, the flow passes through the tubing 610 on the right. This tubing 610 is a conductor section of tubing that allows Data Line(s) to pass through the pressure compensated chamber to the lower portion of the BHA. The tubing 610 is an insulated copper tube used to connect the Data Line(s) to the tools below. This tubing 610 with copper tubular conductor passes through the electric motor as shown, as well as through the gearboxes and bearing assembly. This tubing 610 also directs flow to the lower section of the BHA.

Because the motor control electronics are at the top of the orienter, only one conductor passes through the pressure compensated section. However, in other embodiments, multiple conductors may pass through the pressure compensated section. To pass the conductor(s) through this section, multiple concentric tubes may be utilized. As a nonlimiting example, a titanium tube may be through the center to hold pressure. On the outside of this titanium flowtube, a tubular insulator, copper conductor tube, and/or another tubular insulator may be provided. For a rotary connector, a canted spring may be run over the end of the exposed copper conductor tube. With this arrangement, fewer connections are need and there are fewer points of failure.

Figure 8A:
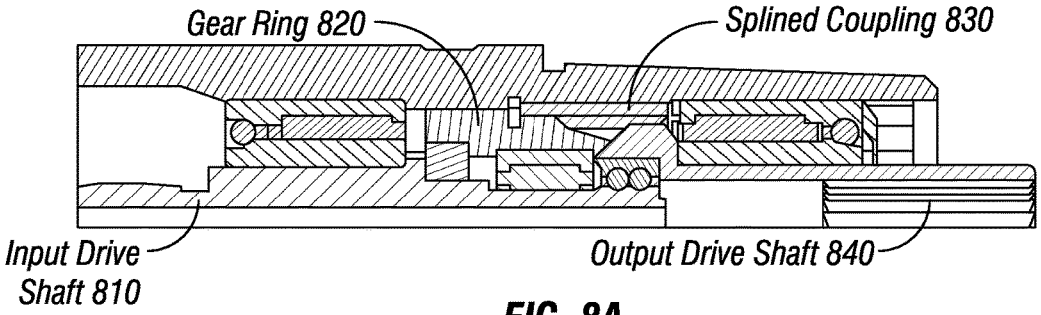
FIGS. 8A-8B respectively show schematics of a first and second stage gearbox.
Figure 8B:
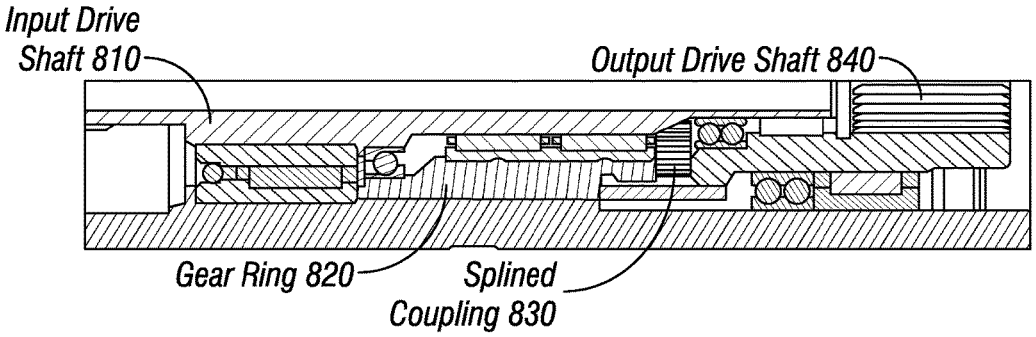

FIGS. 8A-8B respectively show schematics of a first and second stage gearbox. Both the first and second stage gearboxes may be cycloidal in design, where the input shaft 810 has a cam which forces a gear ring 820 to index one tooth for every input shaft revolution. This huge speed reduction provides significant torque output from a small electric motor. The eccentric output from the gear ring 820 is transferred to the concentric output drive shaft 840 by use of a splined coupling 830. As a nonlimiting example, the first stage gearbox may have a 80:1 reduction and the second stage gearbox may have a 38:1 reduction, resulting in a total speed reduction of 3,040:1. Both gearboxes may have a hole through the middle of them to enable the flow tube with an insulated copper conductor to pass through.

Figure 9A:
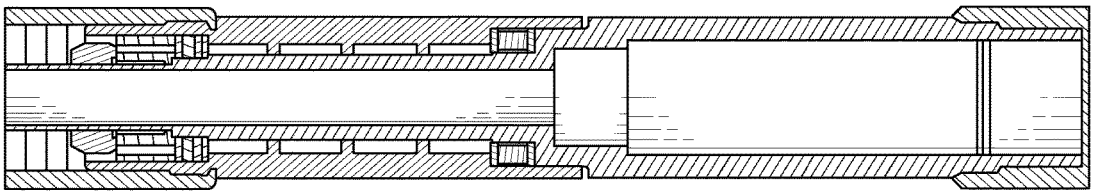
FIGS. 9A-9B are schematics of a bearing assembly and wireline connection.
Figure 9B:
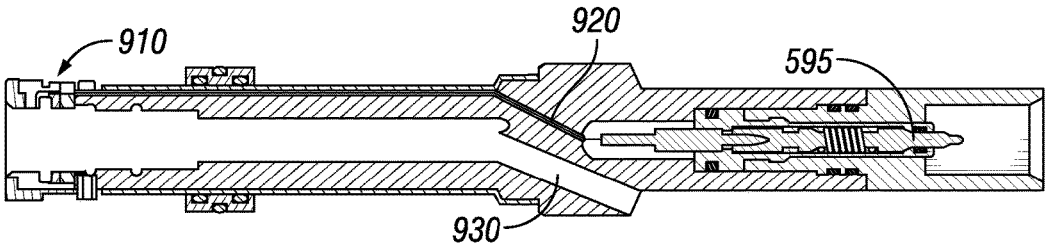

FIGS. 9A-9B are schematics of a bearing assembly and standard wireline connection. Within the bearing/drive assembly, a slip ring assembly 910 exists to transfer the Data Line(s) from stationary to rotatory motion. It is at the slip ring assembly 910 that the rest of the equipment below this point rotates relative to the top of the BHA by use of the electric motor. From the slip ring, the conductor(s) (e.g. Data Line(s)) pass from an annular path to the center of the tool 920 to a connector 595, while as the same point the flow path is redirected from flow through the center to annular flow via a number of angled holes 930.

The crossover at the bottom of the orienter section, where the sensor wire passes from annular to the center of the tool and the flow path passes from the center of the tool to annular flow, contains a standard wireline tool connection 595 that is axially in the center of the tool. From here a range of different single conductor wireline tools can be connected via a spring contact. Mechanical connection is made via the housing on the outside of the downhole steering tool and not via the wireline tools. The wireline tools are mechanically fixed to the bottom of the wireline/sensor section, which the housing is connected to. By doing this the wireline/sensor section can be easily made up with the bottom of the orienter module. As per the cable head and slip nut connection, the wireline/sensor section and orienter connection can be made up in the presence of moisture. This means that the BHA can be rigged up in a wide range of ways, and the best method suitable can be determined for each situation.

The wireline tools are connected to the bottom of the wireline/sensor module by means of a locking mechanism, whereby a datum/reference on the wireline tools can be aligned with a groove on the outer/visible diameter of the downhole steering tool. This gives the ability to see tool datum/reference points on the outside of the BHA, even when the BHA is fully assembled. Below this locking mechanism, the flow path is directed from annular flow between the wireline tools and housing back to the center axial flow. This flow exits the wireline/sensor section through the center to pass through to which ever tool needs to be attached to the end of the BHA.

In some embodiments, this system may be connected to a bent mud motor and bit at the end of the BHA. The bend on the mud motor may be referenced to the datum plane on the wireline telemetry tools. By pumping through the BHA to the mud motor, the mud motor would turn the bit. By pushing the BHA with tubing, a hole would be formed. The direction in which the mud motor bend faced indicates the direction in which the BHA would drill, and this toolface reference can be seen at surface from the information given by the wireline sensor package. Additional information from the wireline sensor package would provide data on direction relative to north and inclination, which can be used along with drilled depth increments to provide a drilled wellpath diagram. One benefit this downhole steering tool has over other tools is a short sensor to bit, providing easier means to drill more accurately and/or to react sooner with directional changes.

In some embodiments, the downhole steering tool can be used with a fixed or adjustable bent sub and wash nozzle on the end of the wireline/sensor section to navigate already drilled multi-laterals, such as to pump fluids to wash and/or stimulate wells or to enter a particular leg in order to fish a tool. In some embodiments, the tool may be used to set whipstocks. In some embodiments, the tool may be used to open and close frac sleeves.

Embodiments described herein are included to demonstrate particular aspects of the present disclosure. It should be appreciated by those of skill in the art that the embodiments described herein merely represent exemplary embodiments of the disclosure. Those of ordinary skill in the art should, in light of the present disclosure, appreciate that many changes can be made in the specific embodiments described and still obtain a like or similar result without departing from the spirit and scope of the present disclosure. From the foregoing description, one of ordinary skill in the art can easily ascertain the essential characteristics of this disclosure, and without departing from the spirit and scope thereof, can make various changes and modifications to adapt the disclosure to various usages and conditions. The embodiments described hereinabove are meant to be illustrative only and should not be taken as limiting of the scope of the disclosure.

What is claimed is:

1. A steering tool system, the system comprising:

a bottom hole assembly (BHA) that includes an orienter, wherein the orienter provides a central flowpath for drilling fluid, orienter circuitry positioned in a sealed environment isolated from the drilling fluid in an annular region adjacent to the central flowpath, an upper pressure bulkhead and a lower pressure bulkhead, wherein the upper and lower pressure bulkhead provide the sealed environment for the orienter circuitry, a motor provided below the sealed environment, wherein the motor rotates the orienter, and the orienter is capable of continuous rotation in either direction, and at least one gearbox coupled to the motor for reducing rotation speed and increasing torque;

a surface control interface (SCI) providing a power supply, power controller, regulator and switching system (RSS), and sensor interface, wherein the SCI is provided at a surface of a well, and the SCI controls the orienter; and a wireline coupled to the SCI that provides multiple conductors, wherein the multiple conductors comprise a ground line, a power line for supplying power to the orienter of the BHA, a direction line for controlling a rotation direction of the orienter, a measurement line for measuring voltage or resistance supplied to the BHA, and a data line dedicated solely for tools of the BHA other than the orienter.

2. The system of claim 1, wherein the multiple conductors separate low power signals from high power signals.

3. The system of claim 1, wherein the SCI controls an amount of power supplied to the orienter and a direction signal supplied to the orienter.

4. The system of claim 1, wherein the wireline runs from the SCI through tubing to a cablehead section of the orienter, and the cablehead section provides a single flow bore that allows drilling fluid to flow through a center of the cablehead section.

5. The system of claim 4, wherein the cablehead section comprises an upper cablehead and a lower cablehead that are mated together for operation, a length of the upper cablehead is 40 inches or less, and the upper cablehead remains made up to an end of coiled tubing during transport to or from a well and separate from the remainder of the orienter and BHA.

6. The system of claim 4, wherein the cablehead section comprises an upper cablehead and a lower cablehead that are mated together for operation, and ends of the upper cablehead and the lower cablehead are keyed to fit one way.

7. The system of claim 6, wherein the upper cablehead and the lower cablehead each provide contacts corresponding to each of the multiple conductors that mate up when the upper cablehead and the lower cablehead are connected together, and each of the contacts are individually sealed.

8. The system of claim 4, wherein the single flow bore provides a fluid pathway from the tubing through the cablehead section to a central flow bore of a hydraulic disconnection section.

9. The system of claim 8, wherein a ball is pumped through the single flow bore to a restriction of the hydraulic disconnection section, and a predetermined pressure applied to the restriction causes a portion of the BHA below the hydraulic disconnect section to release.

10. The system of claim 4, wherein the wireline runs to the orienter, wherein further the power line, the direction line, and the measurement line are coupled to orienter circuitry and terminate at the orienter circuitry, the orienter further provides an electric motor below the orienter circuitry, and the data line passes through the electric motor to a connector at a bottom of the orienter.

11. A steering tool system, the system comprising:

an orienter providing a central flowpath for drilling fluid, orienter circuitry positioned in a sealed environment isolated from the drilling fluid in an annular region adjacent to the central flowpath, an upper pressure bulkhead and a lower pressure bulkhead, wherein the upper and lower pressure bulkhead provide the sealed environment for the orienter circuitry, a motor provided below the sealed environment, wherein the motor rotates the orienter, and the orienter is capable of continuous rotation in either direction, and at least one gearbox coupled to the motor for reducing rotation speed and increasing torque;

a surface control interface (SCI) provided at a surface of a well, wherein the SCI controls the orienter; and a wireline coupled to the SCI that provides multiple conductors, wherein wireline runs from the SCI through tubing to the orienter, and the multiple conductors comprise a ground line, a power line for supplying power to the orienter of a bottom hole assembly (BHA), a direction line for controlling a rotation direction of the orienter, a measurement line for measuring voltage or resistance supplied to the BHA, and at least one data line dedicated solely for tools of the BHA other than the orienter, wherein below the at least one gearbox, the at least one data lines change over from an annular position to a center position of the orienter.

12. The system of claim 11, wherein the motor and the at least one gearbox are annularly positioned in in a pressure compensated region isolated from the drilling fluid.

13. The system of claim 12, wherein the at least one data line passes through the pressure compensated region to the other tools of the BHA.

14. The system of claim 13, further comprising an insulated conductor tube below the pressure compensated region that is concentric to the central flowpath, wherein the at least one data line is coupled to a conductive portion of the insulated conductor tube.

15. The system of claim 14, wherein a connector is coupled to the conductive portion, and the connector is utilized for additional tools for the BHA.

16. The system of claim 15, wherein the connector is a standard wireline tool connection that is suitable for coupling to standard wireline tools.

17. The system of claim 11, wherein below the at least one gearbox, the central flow path for the drilling fluid changes to an annular flow path for the drilling fluid.

18. The system of claim 11, wherein the motor provides mechanical key to stop rotation when the motor is not in operation.

* * * * *